United States Patent [19]

Morabeto

[11] Patent Number: 4,645,208

[45] Date of Patent: Feb. 24, 1987

[54] GOLF TEE

[76] Inventor: James W. Morabeto, 905 Maple Ave., Pittsburgh, Pa. 15234

[21] Appl. No.: 779,926

[22] Filed: Sep. 25, 1985

[51] Int. Cl.[4] ..... A63B 57/00

[52] U.S. Cl. ..... 273/207

[58] Field of Search ..... 273/33, 207, 204, 210

[56] References Cited

U.S. PATENT DOCUMENTS

| | | | |
|---|---|---|---|
| 2,712,939 | 7/1955 | Harp | 273/207 |
| 2,839,304 | 6/1958 | Lerick | 273/207 |
| 2,966,214 | 6/1976 | Collins | 273/207 |
| 3,414,268 | 12/1968 | Chase | 273/207 |
| 4,524,974 | 6/1985 | Matsuura | 273/207 |

*Primary Examiner*—Richard C. Pinkham

*Assistant Examiner*—T. Brown

*Attorney, Agent, or Firm*—William J. Ruano

[57] ABSTRACT

A tiltable golf tee comprising a ground piercing stem portion having an integral stop for limiting the extent of piercing into the ground. The stop has a plurality of upstanding flanged fingers having truncated inner spherical surfaces forming a universal joint with a ball integrally formed at the base of an upper tiltable portion which supports the golf ball. With such construction, the upper tiltable portion, when struck while swinging the driver club, will offer practically no resistance in tilting, allowing full power of the swing to be transmitted directly to the ball irrespective of the direction of swing.

4 Claims, 5 Drawing Figures

GOLF TEE

This invention relates to a golf tee and more particularly to one that is flexible or tiltable.

BACKGROUND OF THE INVENTION

Pivotal golf tees are known in the art, such as shown in U.S. Pat. No. 3,406,978, dated Oct. 22, 1968, and U.S. Pat. No. 3,966,214, dated June 29, 1976. However, such patented tees are pivotal in only one direction or vertical plane so that unless the plane of swing of a golf club coincides exactly with the plane of pivoting of the golf tee, resistance to the golf swing wll arise and a tendency of a tee to break would be great. Another disadvantage of the patented tees is that they are relatively complicated in construction and very expensive to manufacture in large quantities. Also, they canot be placed in the ground at exactly the same height with ease.

An object of the present invention is to provide a novel tiltable golf tee that overcomes the above-named disadvantages.

A more specific object of the invention is to provide a golf tee having a universal pivotal mounting so that it will tilt with great ease regardless of the direction of swing of the golf club.

A further object of the invention is to provide a novel tiltable golf tee with a built-in stop that will rest on a ground surface to insure an identical height of the golf ball supported thereon at all times.

Another object of the invention is to provide a tiltable golf tee of relatively simple and inexpensive construction that will lend itself to mass production methods at minimum cost.

Other objects and advantages of the invention will become more apparent from a study of the following description taken with the accompanying drawing wherein.

Figure 1:
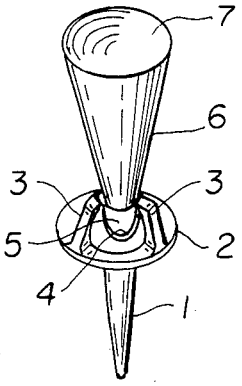
FIG. 1 is a top perspective view of a tiltable golf tee embodying the principles of the present invention.
Figure 2:
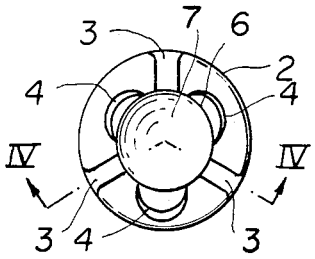
FIG. 2 is a top view thereof.
Figure 4:
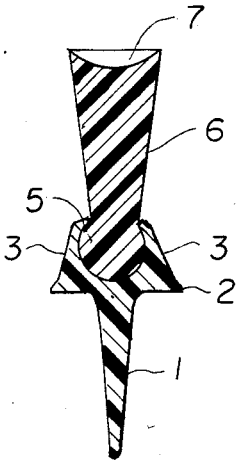
FIG. 4 is a vertical cross-sectional view taken along line IV—IV of FIG. 2.

Referring more particularly to FIG. 1 to FIG. 5 inclusive, the entire assembly of the golf tee is preferably made of plastic material, such as polyetheylene, although it may be made, instead, of wood or any other material, and comprises two parts joined together by a universal joint.

The base comprises a pointed stem portion 1 which is to be pierced into the ground and an integral stop portion 2 which rests on the ground and limits the extent of penetration into the ground to insure that the level or height of the golf ball supported on the tee will be the same at all times. The stop portion 2 has a diameter about twice that of stem 1 and has integral therewith a plurality of flanged curved fingers 3, preferably three, separated by "U"-shaped openings 4, which flanged fingers have an interior spherical shape so as to closely embrace and fit and form a universal joint with the spherical portion 5 of an upper tiltable tee portion 6 which has a truncated spherical surface 7 to serve as a seat for the golf ball. The flanged curved fingers 3 are yieldable to an extent such that the upper portion 6 can be pulled out of the socket provided by the flanged finger portion inner surfaces. This is of great benefit in assembly since the flanged finger portions provide a snap-fit with the upper portion 6.

Figure 3:
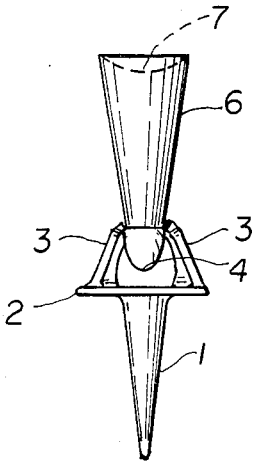
FIG. 3 is a front elevation view thereof.
Figure 5:
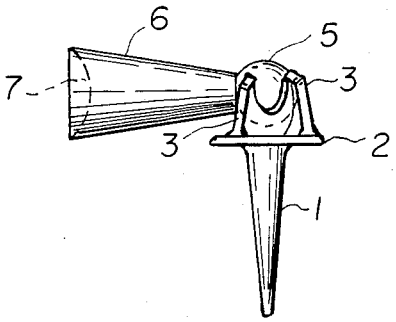
FIG. 5 is an elevational view thereof, the upper portion being in tilted position after the golf ball has been driven therefrom.

In operation, when the golf tee assembly is stuck into the ground by having the stem portion 1 penetrate it until limited from further penetration by stop 2, the height of seat 7 from the ground, when the tee assembly is in the position shown in FIG. 3, will be constant at all times. There will be no necessity of aligning the assembly with the vertical plane of swing of a club since this does not matter because of the universal joint between the upper part 6 and the portion 2. When a golfer makes a drive and hits the ball supported on seat 7, the upper or tee portion 6, when struck, will easily and with negligible resistance, tilt from the position shown in FIG. 3 to that shown in FIG. 5, or perhaps to an intermediate position, without damage to the tolf tee assembly. Therefore, the golfer can transmit full power of his drive in hitting the ball far more than possible with existing tees, particularly those that must absorb part of the power of the drive, from breakage of the tee, which often occurs.

The upper part 6 may be made of different sizes and snap-fitted to the same base. Likewise, the stem portion 1 can be made of different lengths and can be snap-fitted to the same or a different sized upper or tee portion. Therefore, the assembly provides great flexibility of use.

Thus it will be seen that I have provided a novel and efficient tiltable golf tee affording practically no resistance to the swing of the golf club during driving and which can be easily placed into the ground with assurance of a given height of the top seat of the tee in relationship to the ground surface, insuring accuracy of successive drives; also, I have provided a relatively simple and inexpensive golf tee assembly which lends itself to mass production methods, therefore which can be made inexpensively as compared to known types of tiltable golf tees; also, I have provided a tiltable golf tee of such construction as to have a long life because of the low tendency of breaking.

While I have illustrated and described a single specific embodiment of my invention, it will be understood that this is by way of illustration only and that various changes and modifications may be contemplated in my invention within the scope of the following claims.

I claim:

1. A golf tee of plastic material comprising a round base portion integrally formed with a ground piercing stem of substantially smaller diameter so that said base portion acts as a limit stop to limit the extent of piercing of said tee into the ground, a plurality of curved fingers of equal size integrally extending upwardly from said base portion, said fingers collectively having a truncated spherical inner face, a substantially inverted cone-shaped ball-supporting portion having a truncated spherical inner face at the top thereof for supporting a golf ball, said ball-supporting portion being detachably secured to said base by having, at the bottom thereof, a spherical portion forming a snap fit with said truncated spherical surface of said base portion, the spacing between said fingers being sufficiently large as to fit about the bottom portion of said ball-supporting portion whereby when a golf ball supported on said inner face is struck, said ball-supporting portion will tilt to approximately a horizontal position between two of said fingers.

2. A golf tee as recited in claim 1 wherein there are three of said fingers.

3. A golf tee as recited in claim 2 made of polyethylene and wherein said base portion is about twice the diameter of said stem.

4. A golf tee as recited in claim 2 together with three integral vertical reinforcing ribs, each formed on the outside of one of said fingers.

* * * * *